US011047102B2

(12) United States Patent
McMillan

(10) Patent No.: US 11,047,102 B2
(45) Date of Patent: Jun. 29, 2021

(54) DISPLACEMENT AND/OR COMPACTION DEVICE

(71) Applicant: Jaron Lyell McMillan, Canterbury (NZ)

(72) Inventor: Jaron Lyell McMillan, Canterbury (NZ)

( * ) Notice: Subject to any disclaimer, the term of this patent is extended or adjusted under 35 U.S.C. 154(b) by 80 days.

(21) Appl. No.: 16/309,469

(22) PCT Filed: Jul. 7, 2017

(86) PCT No.: PCT/IB2017/054090
§ 371 (c)(1),
(2) Date: Dec. 13, 2018

(87) PCT Pub. No.: WO2018/007983
PCT Pub. Date: Jan. 11, 2018

(65) Prior Publication Data

US 2019/0316312 A1 Oct. 17, 2019

(30) Foreign Application Priority Data

Jul. 8, 2016 (NZ) ..... 721981

(51) Int. Cl.
*E02D 3/08* (2006.01)
*E02D 5/56* (2006.01)
(Continued)

(52) U.S. Cl.
CPC ..... *E02D 3/08* (2013.01); *E02D 3/054* (2013.01); *E02D 5/56* (2013.01); *E02D 7/22* (2013.01); *E21B 10/44* (2013.01); *E21B 7/26* (2013.01)

(58) Field of Classification Search
CPC .... E02D 3/08; E02D 3/12; E02D 5/56; E02D 27/12
See application file for complete search history.

(56) References Cited

U.S. PATENT DOCUMENTS 3,864,923 A * 2/1975 Turzillo ..... E02D 5/38 405/238
4,046,205 A * 9/1977 Asayama ..... E02D 5/44 175/292

(Continued)

FOREIGN PATENT DOCUMENTS

EP 0324703 7/1989
NZ 618804 1/2014

(Continued)

*Primary Examiner* — Frederick L Lagman
(74) *Attorney, Agent, or Firm* — Galbreath Law Offices, P.C.; John A. Galbreath

(57) ABSTRACT

A drill assembly that includes one drill and a displacement unit, where the drill is releasably or permanently attached to said displacement unit, such that: —the displacement unit includes a guide unit and a channel unit, where the channel unit includes a guide channel, and said guide unit includes one or more guides adapted to engage with said guide channel, such that said guide channel is a circumferential channel that follows a wave or wave like path; —the drill includes a drill bit and/or a drill flight attached to a central shaft, wherein the drill bit and/or drill flight co-terminate at a first terminal end of the drill; —said first terminal end is the terminal end of the drill that is configured to enter the ground first; and—the central shaft is a thin elongate member that extends between the longitudinally separated terminal ends of the drill.

33 Claims, 11 Drawing Sheets

(51) Int. Cl.

| | |
|---|---|
| ***E02D 7/22*** | (2006.01) |
| ***E02D 3/054*** | (2006.01) |
| ***E21B 10/44*** | (2006.01) |
| *E21B 7/26* | (2006.01) |

(56) References Cited

U.S. PATENT DOCUMENTS

| | | | | |
|---|---|---|---|---|
| 4,637,758 | A * | 1/1987 | Tamaki | E02D 7/20 405/232 |
| 9,115,477 | B2 * | 8/2015 | Mcmillan | E02D 3/08 |
| 9,365,997 | B2 * | 6/2016 | McMillan | E02D 3/08 |
| 2008/0101873 | A1 * | 5/2008 | Fox | E02D 5/44 405/239 |
| 2014/0023443 | A1 | 1/2014 | McMillan | |

FOREIGN PATENT DOCUMENTS

| | | | | |
|---|---|---|---|---|
| WO | WO-2012137118 | A1 * | 10/2012 | E02D 3/08 |
| WO | WO2014/091395 | | 6/2014 | |
| WO | WO-2014091395 | A1 * | 6/2014 | E02D 3/08 |

* cited by examiner (v)
(vi)
(vii)
(viii)
-34-
-32-
I
C
E
AC
3
10
11
13
22
23
33
40
41
43
46

DISPLACEMENT AND/OR COMPACTION DEVICE

TECHNICAL FIELD

The present invention is a displacement or compaction device that moves a shaft co-axially once engaged. In particular it is a displacement device attached to a drill shaft that, when engaged, the drill moves co-axially to compact the surrounding material and/or clear aggregate/material being delivered to that material.

BACKGROUND ART

When ground needs to be consolidated prior to construction of structures upon that ground, or aggregate material is compacted into a column, it is often accomplished by vibrating the ground or aggregate. There are a variety of methods used to generate this vibratory motion for example, eccentric weights on rollers or wheels, pneumatic and/or hydraulic The first method which uses a roller or wheel with an eccentric weight attached, as the roller/wheel is rotated the weight applies an oscillating force which causes a vibratory motion. This vibratory motion is passed onto anything the vibrator is attached to, and/or in contact with. The vibratory force, and the frequency of that force, is determined by the mass of the weight and the rpm of the wheel/roller. In general the axis of rotation of the wheel/roller is approximately perpendicular to the shaft/rod/drill vibrated, so that the shaft/rod/drill is longitudinally vibrated. The vibratory force applied can be varied by changing the rpm of the roller or wheel and the eccentric weight's mass. This form of vibrator does require a means to drive the wheel or roller which is often separate to any device driving or rotating the shaft/rod/drill. To apply complex vibratory motion to the rod/shaft/drill more than one roller or wheel with an eccentric weight attached may be needed. These eccentric weight vibrators can apply off axis forces unless in contact with an end of the rod/shaft/drill and require a separate drive device to rotate them.

The pneumatic and hydraulic vibrators can be complex and noisy devices making them expensive and/or unsuitable for some applications where noise is an issue.

One form of vibrator is located at the end of the drill/rod/shaft within the ground, should the vibrator fail the drill/rod/shaft needs to be withdrawn to repair the vibrator. In some cases, as the vibrator is located in an expanded section of the drill/rod/shaft it may be difficult to recover the vibrator for those repairs. To overcome this some vibrators apply their vibratory impulses to the exposed end of the drill/rod/shaft.

Many of the vibrators described are housed within an expanded torpedo like section of the probe which is inserted into the ground first. The common form of this vibrator is limited in the amount of radial compaction able to be achieved as it is normally vibrated into the ground without any rotation In fact one common variant of this device incorporates water jets at the tip to assist with compaction and insertion.

Vibration devices are often complex pieces of equipment with many separate components able to fail.

WO/2014/091395 describes a dual concentric drill with a tubular first drill within which a second drill at least partially lies. The displacement device in this document displaces the first drill with relation to the second drill, and both drills are required to achieve the stated objectives.

Any discussion of the prior art throughout the specification is not an admission that such prior art is widely known or forms part of the common general knowledge in the field.

The present invention provides an alternative vibratory device that provides the consumer with a useful choice, it may also avoid some of the problems of existing vibratory devices described above.

DISCLOSURE OF INVENTION

The present invention provides a displacement unit which includes a guide unit and a channel unit, where the channel unit includes a guide channel, and said guide unit includes one or more guides adapted to engage with said guide channel, such that said guide channel is a circumferential channel that follows a wave or wave like path.

The invention further provides a drill assembly that includes one drill and the displacement unit, where the drill is releasably or permanently attached to said displacement unit, such that the drill includes a drill bit and/or a drill flight attached to a central shaft, wherein the drill bit and/or drill flight co-terminate at a first terminal end of the drill, said first terminal end is the terminal end of the drill that is configured to enter the ground first and the central shaft is a thin elongate member that extends between the drills longitudinally separated terminal ends. Preferably said drill is an auger. Preferably said drill bit includes a bulb end. Preferably when both a drill flight and a drill bit are present only the drill bit co-terminates at the first terminal end. In an alternative preferred form when both a drill flight and a drill bit are present only the drill flight co-terminates at the first terminal end.

Preferably said drill assembly includes a delivery tube which circumferentially surrounds a portion of the central shaft. Preferably said delivery tube is not configured to directly act as an additional drill. Preferably the drill flight terminates at a flight termination point which is short distance, the separation distance (sd), from an outlet terminal end of the delivery tube. Preferably a maximum outside diameter of the drill flight and/or drill bit (D) is greater than an outside diameter of the delivery tube (do).

Preferably the maximum outside diameter of the drill flight and/or drill bit (D) is at least 1.1× that of the outside diameter of the delivery tube (do). In a highly preferred form it is at least 2×. In a still further preferred form it is between 2× and 10×. In a still more preferred form it is between 2× and 6×.

In one preferred form with a delivery tube, the delivery tube does not rotate with the drill.

Preferably the separation distance (sd) is from 0 mm to 10 times the outside diameter of the delivery tube (do). Preferably sd is between 0 mm and 50 mm.

Preferably the drill assembly includes a hopper which is configured to hold additional material, such that said hopper is connected to the delivery tube in such a way as to allow the additional material to flow from the hopper and through the delivery tube when required.

In one preferred form the delivery tube is connected to the central shaft by at least one shaft-tube attachment so that the feed tube is configured to rotate with the central shaft. In a preferred form the at least one shaft-tube attachment does not pass on any longitudinal motion of the drill to the delivery tube. In a preferred form any longitudinal motion over a certain pre-set limit is passed on to the delivery tube. In an alternative form the at least one shaft-tube attachment is a rigid connection between the delivery tube and the central shaft so that any rotational and/or longitudinal motion of the central shaft is transmitted to the delivery tube.

Preferably, where the delivery tube is present, the delivery tube includes a tube cap, where the tube cap partially or completely blocks an outlet terminal end of said delivery tube such that said tube cap is configured to release from the delivery tube when required. In an alternative preferred form the drill includes a tube plug which is attached to or forms part of the central shaft, the tube plug, which, in a first position, lies within the delivery tube, said tube plug, in this first position, extends between the central shaft and interior wall of the delivery tube acting as a seal or plug for the delivery tube. Preferably there is a clearance between the interior wall of the delivery tube and the tube plug, this clearance is sufficient to allow differential motion, rotational or axial.

In a further preferred form the drill includes a shaft flight that extends along a portion of the length of the central shaft that lies at least partially within the delivery tube. In one preferred form a terminal end of said shaft flight is coterminous with the drill flight at the flight termination point. In an alternative form the shaft flight and drill flight terminate at opposite sides of the tube plug. In a preferred form the drill flight and/or the shaft flight terminate a short distance from the tube plug.

The present invention further includes only a single drill in the form of an auger with a central shaft and a drill flight, where the drill is permanently or releasably attached to a displacement device, where the displacement device includes a guide unit and a channel unit, where the channel unit includes a guide channel, and said guide unit includes one or more guides adapted to engage with said guide channel, such that said guide channel is a circumferential channel that follows a wave or wave like path, such that, when engaged, the displacement unit imparts a vibration or longitudinal oscillation to the drill that is configured to modify the properties of material surrounding said drill.

Preferably the guide channel follows a smooth wave like path. In a highly preferred form the guide channel is approximately sinusoidal.

In a preferred form the guide channel is at least 1, and up to 100 (inclusive), wavelengths in length. In a still more preferred form the number of wavelengths is between 1 and 10 inclusive.

In an alternative form the guide channel is made up of a plurality of partial waves or a superposition of waveforms. Preferably the guide channel is a superposition of two or more separate subsidiary waveforms, each subsidiary waveform having a different wavelength and/or peak to trough distance.

Preferably the guide channel has a peak to trough distance of between 1 mm and 400 mm. In a highly preferred form the peak to trough distance is 25 mm to 100 mm. In a still more preferred form the peak to trough distance is 50 mm.

In a highly preferred form sd is between one and 10× the peak to trough distance.

In a preferred form, where a delivery tube is present, the drill includes a tube plug which is attached to or forms part of the central shaft, said tube plug in a first position lies within the delivery tube and extends radially from the central shaft towards the delivery tube, such that said tube plug is dimensioned to effectively seal or block the delivery tube in said first position. Preferably the tube plug is a clearance fit within the delivery tube.

Preferably the drill includes an alpha section which is a portion of the drill with a maximum cross sectional dimension greater than a maximum cross sectional dimension of the central shaft. Preferably said alpha section is located within the portion of the drill that includes the drill flight. Preferably the alpha section, in cross section, is circular, oval or elliptical, with the longest axis being the maximum cross sectional dimension.

The invention also provides a preferred method of using a drill assembly including a displacement device and a drill which includes the following steps:

(i) Insert drill into a ground surface;

(ii) Continue drilling until a required depth is reached then engage the displacement device to commence compacting/consolidating surrounding ground material;

(iii) Withdraw drill with displacement device operating;

the displacement device includes a guide channel, and said guide unit includes one or more guides adapted to engage with said guide channel, such that said guide channel is a circumferential channel that follows a wave or wave like path which, when engaged causes the drill to be displaced longitudinally (the drill vibrates or oscillates).

Preferably said drill is an auger. In a preferred form of the method the drill includes a delivery tube configured to provide a pathway for aggregate into the ground. In a preferred form the delivery tube is sealed by a tube plug, where said tube plug can be moved to unseal the delivery tube in step (iii), allowing aggregate to pass through said delivery tube.

BRIEF DESCRIPTION OF DRAWINGS

By way of example only, a preferred embodiment of the present invention is described in detail below with reference to the accompanying drawings, in which.

DEFINITIONS

Aggregate: when used herein is construction aggregate above about 0.1 mm in size (including sand, stones, crushed rock, crushed concrete, slag, etc).

Auger: when used herein includes a flight without a central shaft, similar to a corkscrew.

Drill bit: when used herein is the terminally located portion of a drill that enters the ground first, a drill bit is intended to ease the insertion, or the movement, of the drill into the ground;

Flight: when used herein is a strip of material following a helical path like a spiral staircase.

Rotary or Rotary Head: The rotational drive unit, normally incorporating hydraulic motors, used to rotate a drill. They may drive the drill directly or through a gearbox of some description.

Tube: when used herein a tube is meant to indicate a long hollow member whose outer cross sectional profile may be circular or any other shape (triangular, square, hexagonal, elliptical, etc.) and whose inner cavity is circular (or approximately circular/elliptical) in cross section.

Please note the drawings are representative only, they are not to any scale and the relative dimensions may be exaggerated for clarity. For example, but not limited to, the wall thickness of various components are likely to be exaggerated, as otherwise the details would simply not be apparent.

BEST MODE FOR CARRYING OUT THE INVENTION

Figure 1:
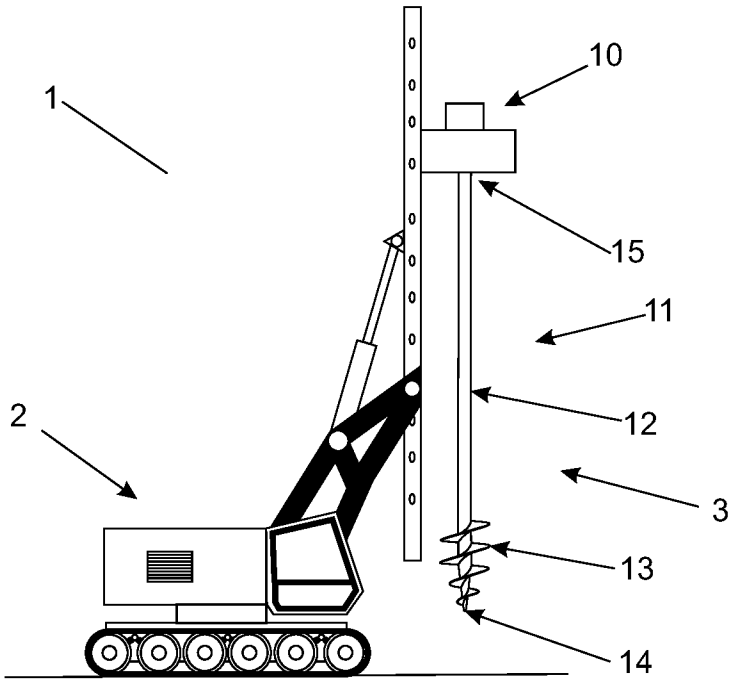
FIG. 1 is a pictorial view of a drilling rig with the displacement compaction device attached to a single drill.

Referring to FIG. 1 a drilling rig (1) that includes an excavator/crane (2) and drill assembly (3) is shown. The drill assembly (3) includes a displacement unit (10) and a drill (11), where the drill (11) is an auger with a central shaft (12) to which a drill flight (13) is attached.

Figure 2:
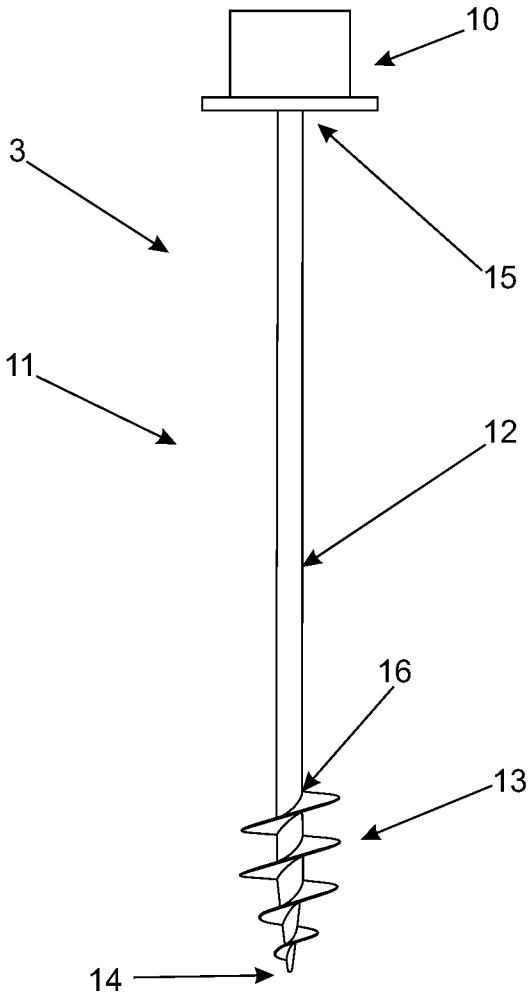
FIG. 2 shows a pictorial view of the displacement compaction device attached to a single drill without the drilling rig.

Referring to FIGS. 1 and 2 the drill assembly (10) is shown as part of the drilling rig (1), and separately, respectively. The drill (11) includes a first end (14) and a second end (15) where these ends (14, 15) are the opposite terminal ends of the drill (11), and in the variant shown, coterminous with the terminal ends of the central shaft (12). The first end (14) is the end of the drill (11) that enters the ground surface first when the drill (11) is used. The drill flight (13) co-terminates with the central shaft (12) at the first end (14) and extends along the central shaft (12) to terminate at a flight termination point (16).

Figure 4:
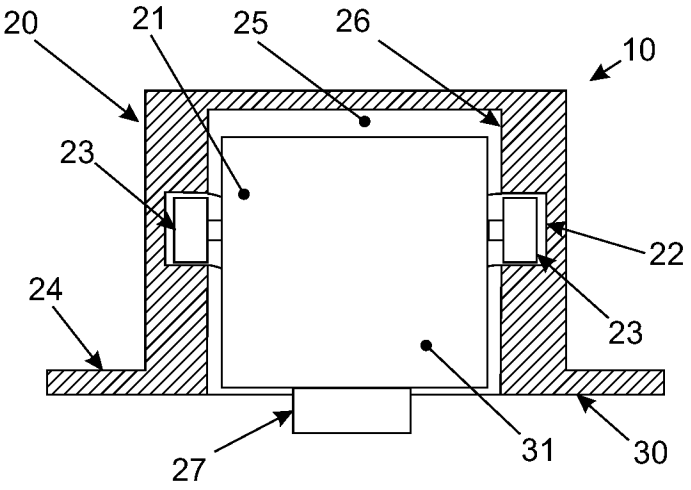
FIG. 4 is a cross sectional view of a second form of the displacement/compaction device removed from the drill.
Figure 3:
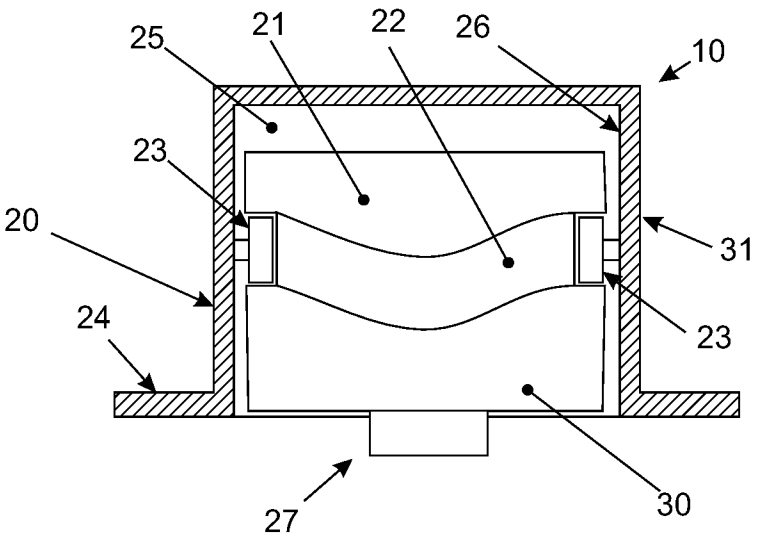
FIG. 3 is a cross sectional view of a first version of the displacement/compaction device removed from the drill.

FIGS. 3 and 4 show an expanded cross-sectional view of the displacement unit (10) which in this variant includes a displacement cover (20), a core section (21), a guide channel (22) and two guides (23), this number can be anything from 1 upwards but it is believed that two is optimum. FIG. 3 shows a first form of the displacement unit (10) and FIG. 4 shows a second form of the displacement unit (10)

The displacement cover (20) is shown as having a similar shape to a top hat, with the brim forming an outer lip (24), and the void within forming a core cavity (25). The core cavity (25) is dimensioned to contain the core section (21) whilst not preventing it from rotating about its longitudinal axis within the core cavity (25). The core cavity (25) includes a core cavity face (26) which is the inside surface of the core cavity (25) facing the longitudinal axis of the displacement cover (20). When assembled the displacement cover (20) and core section (21) are longitudinally co-axial.

In the first form, shown in FIG. 3, the core section (21) is cylindrical with the guide channel (22) being a continuous circumferential channel cut into the outer surface of that cylinder. The two guides (23) are shown diametrically opposed and extending from the core cavity face (26), into, and making contact with, one or both of the side walls of the guide channel (22).

In the second form, as shown in FIG. 4, the core cavity (25) has a circular trans-axial cross section, with respect to the longitudinal axis. The guide channel (22) in this second form is a continuous circumferential channel cut into the core cavity face (26) which is dimensioned to accept the guides (23).

In both forms the guides (23) are dimensioned to slide or roll within the guide channel (22). The guides may be rollers or wheels (cylindrical, conical, spherical or any other suitable shape) attached to shafts, solid or hollow pieces of material that slide along the guide channel (22), or thin resilient pieces of material that are biased to contact one or both side walls of the guide channel (22). In addition the guides (23) may be free to rotate, have restricted rotational or no rotational capacity.

The waveform of the guide channel (22) is likely to be approximately sinusoidal (or the superposition of a plurality of approximately sinusoidal waveforms) and have a peak to trough distance of between 1 mm and 400 mm. The preferred peak to trough distance is between 20 mm and 100 mm. The figures show a guide channel (22) two wavelengths in length, but this will depend on the rotational speed of the drill (11), the required vibration and the peak to trough distance of the guide channel (22). The length of the guide channel (22) will be at least 1 wavelength and could be up to 100 wavelengths, but, the number is preferably in the range of between 1 and 10 wavelengths for most applications. It is felt that the waveform will consist of a whole number of waves of the same waveform and wavelength, but, some applications may benefit from a variable waveform consisting of a number of partial or whole wavelengths of the same or different waveforms and/or frequencies. The guide channel (22) may also benefit from discontinuities. It should be noted that the waveform can be a superposition of different waveforms, where those superimposed waveforms have different wavelengths and/or peak to trough heights. For example a wave with a periodicity of 1 with a peak to trough of 25 mm could be combined with a wave with a periodicity of 10 and a peak to trough of 1 mm, so the displacement unit imparts a slow large movement combined with a faster short displacement at the same time, the higher frequency low wave could be discontinuous imparting a rapid oscillation to the drill (11) intermittently.

In both forms shown in FIGS. 3 and 4 the core section (21) includes a connection section (27) which is designed to permanently or releasably connect the drill (11) to the core section (21). In some cases the connection section (27) is rigidly attached to both the core section and the drill (11), in other configurations the drill (11) and core section (21) are parts of the same component, and in still other configurations the connection section (27) is a releasable joint that allows different core sections (21) to be attached to change the vibratory motion applied by the displacement unit (10) to the drill (11).

Figure 4A:
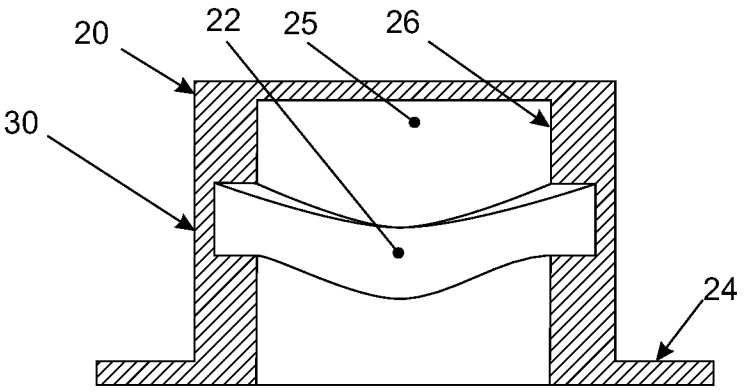
FIG. 4*a* is a cross sectional view of the displacement cover of the second form in isolation.

FIG. 4*a* shows the displacement cover (20) of the second form of the displacement unit (10) to show the wavelike path the guide channel (22) follows clearly.

To avoid complex constructions, from this point onwards, we will refer to the component including the guide channel (22) as the channel unit (30) and the component including the guides (23) as the guide unit (31). This numbering is present in FIGS. 3 and 4 for clarity.

Figure 5:
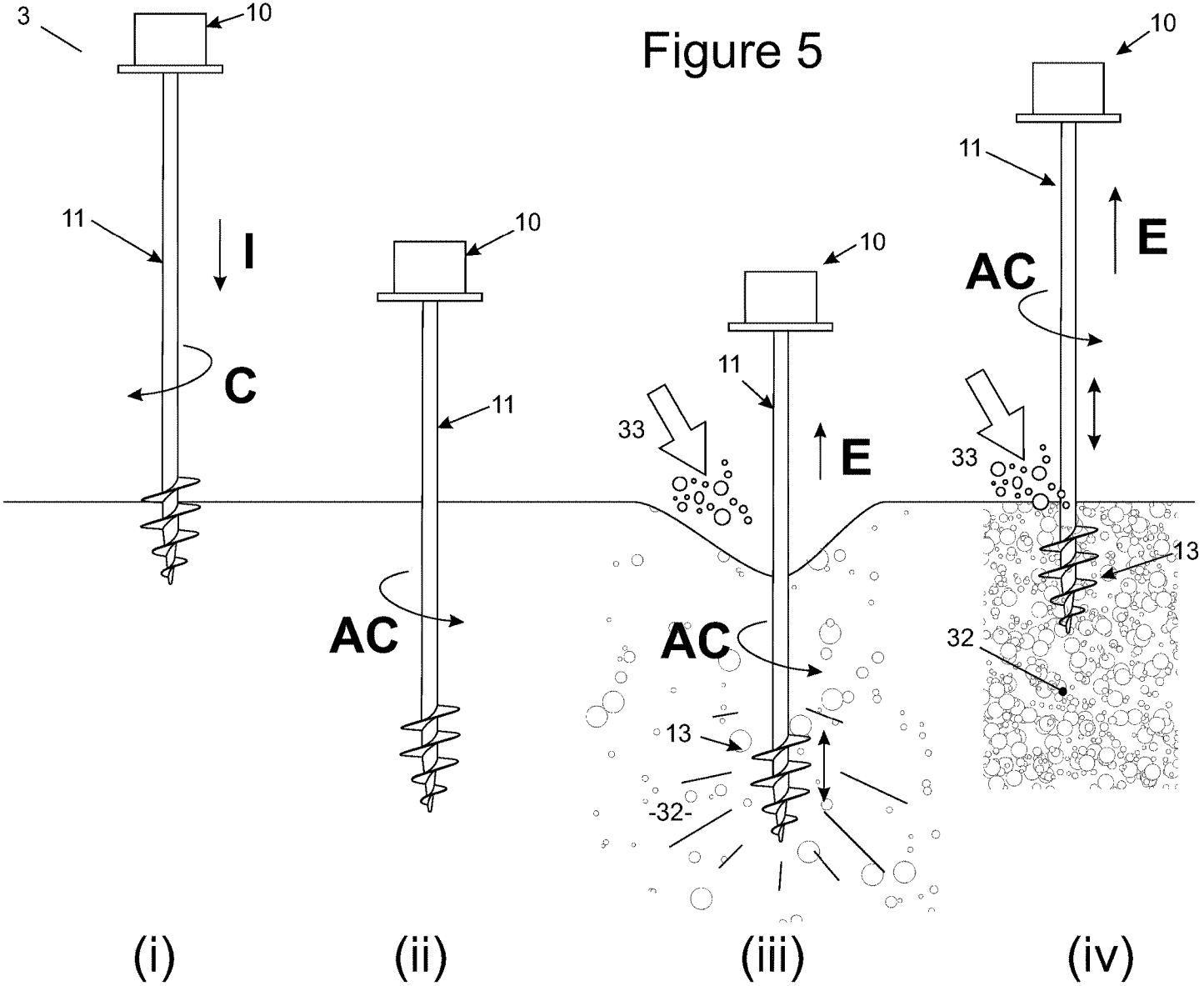
FIG. 5 is a series of four pictorial views that show a method of compacting the ground using the displacement/compaction device.

Referring to FIG. 5 (and where necessary FIG. 3, 4 or 4*a*) one method of using the drill assembly is shown, with the drill assembly (3) shown in isolation from the drilling rig (1) (see FIG. 1).

Step (i) The drill (11) is rotated in the direction of arrow C as the drill assembly (3) is pushed into the ground in the direction of arrow I.

Step (ii) The drill (11) reaches full depth and it is stopped, then the rotational direction of the drill (11) reversed, to rotate in the direction of arrow AC, at this time the displacement unit (10) is engaged.

Step (iii) The interaction between the guides (23) in the guide channels (22) causes the drill (11) to longitudinally oscillate (be periodically longitudinally displaced as it is rotated in the opposite direction to step (i), in the direction of arrow AC, and this compacts the material (32) around the drill flight (13). This compaction, modification and/or displacement sometimes causes the ground surface to distort or sink, this can require additional material (33) to be added. At the same time the drill (11) is extracted from the ground in the direction of arrow E.

Step (iv) The drill (11) is rotated in the reverse direction, in the direction of arrow AC, and withdrawn from the ground, in the direction of arrow E, at a rate which compacts the material and incorporates any additional material (33) supplied to the required level. This operation forming a compacted zone of material (32) that starts at or below the maximum drill (11) depth and extends to the surface, or a point between the lower compacted zone and the surface. The amount of compaction can be varied by adjusting the rotational speed of the drill (11), the withdrawal rate, the torque of the drill and the amount/type of additional material (33) added for example.

The reverse rotation of the drill (11) forces the material (32)/additional material (33) out radially as well as downwardly which, when combined with the vibratory motion imparted by the displacement unit (10), is believed to compact material better than either of these alone. For example the radial motion can be used to form a compacted column of material with a more highly compressed wall than core. Alternatively a large zone of ground surrounding the drill (11) can be compacted by the combination of the radial and vibratory forces applied by the drill (11) in combination with the displacement unit (10).

Figure 7:
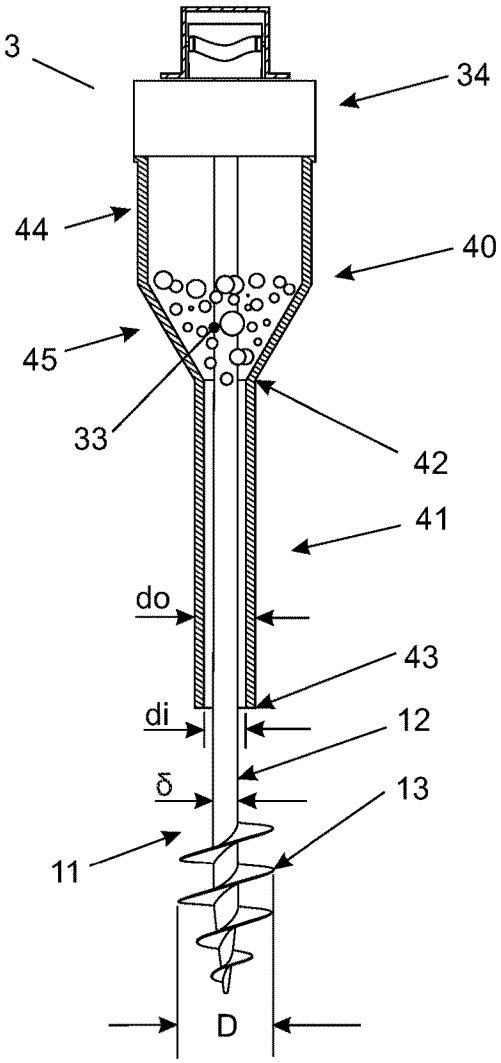
FIG. 7 is a sectional view of the drill assembly of the second embodiment, with the rotary head shown.
Figure 6:
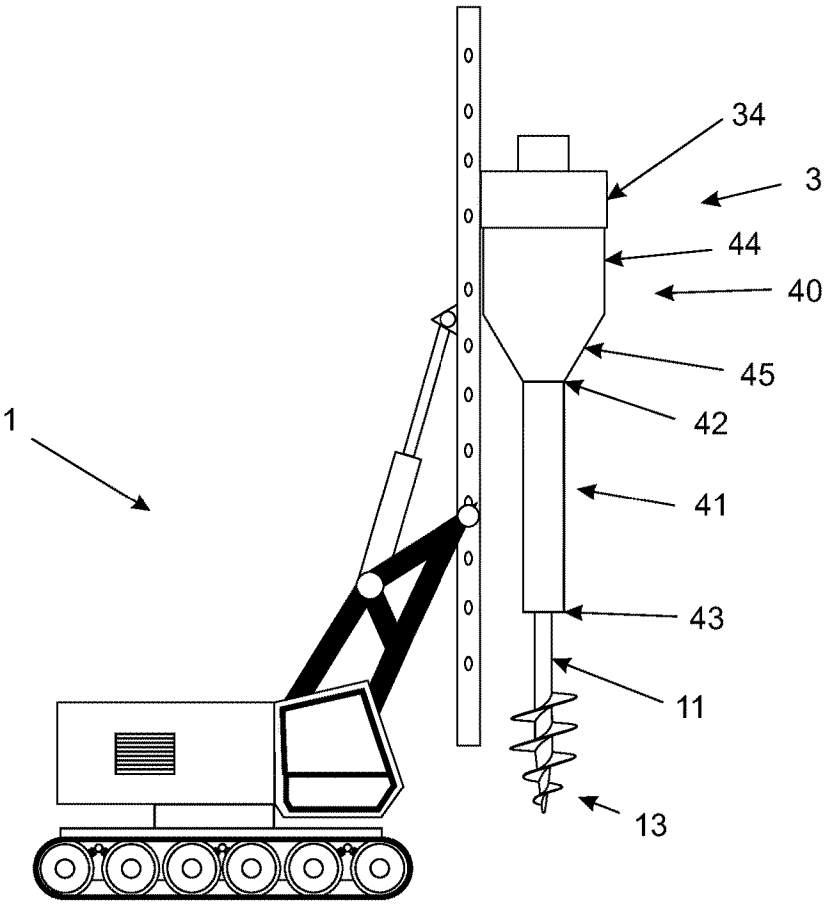
FIG. 6: is a pictorial view of a second embodiment of the invention which incorporates a tubular delivery tube surrounding the drill shaft.

Referring to FIG. 6 and FIG. 7 a second embodiment of the drill assembly (3) engaged with a rotary head (34) is shown as part of a drilling rig (1), and as a separate sectional item, respectively. The drilling rig (1) includes a rotary head (34) used to drive the drill (11).

In this second embodiment the drill assembly (3) includes a hopper (40) and a delivery tube (41) which surrounds a portion of the drill (11). The delivery tube (41) includes an inlet terminal end (42) and an outlet terminal end (43), which are opposite terminal ends of the delivery tube (40).

The hopper (40) is shown as including a cylindrical section (44) immediately above a frusto-conical section (45), where the base of the frusto-conical section (45) is coterminous with the base of the cylindrical section (44). The other terminal end of the frusto-conical section (45) is coterminous with the inlet terminal end (42), of the delivery tube (41).

The drill (11), hopper (40) and the delivery tube (41) are co-axially aligned with the drill (11) extending from the outlet terminal end (43) of the delivery tube (41). In use the hopper (40) is used to hold the additional material (33). The delivery tube (41) provides a pathway from the inside of the hopper (40) to a point longitudinally separated from the drill flight (13).

The inside diameter (di) of the delivery tube (41) is greater than the outside diameter (δ) of the central shaft (12), and the outside diameter (do) of the delivery tube (41) is less than the maximum outside diameter (D) of the drill flight (13). This configuration means that the drill flight (13) can impart the required radial force to the material (32) and additional material (33). Please note that at least FIGS. 7, 8 and 10-12 have exaggerated wall thicknesses to allow certain features to be visible.

The outlet terminal end (43) may be located close to the start of the drill flight (13), or anywhere up to a point close to coterminous with the inlet terminal end (42). When the outlet terminal end (43) is close to the drill flight (13) it is sufficiently distant so as to allow the repetitive longitudinal displacement imparted by the displacement unit (10) to the drill (11) to occur. The optimum will vary between these extremes and it is likely it will normally be within the ground when the compaction/modification commences. The minimum distance between the outlet terminal end (43) and the start of the drill flight (13) is the separation distance (sd), shown on FIG. 10 for clarity, and this can be anything from 0 mm. This separation distance is applicable to any variant or embodiment which incorporates a delivery tube (41).

Figure 8:
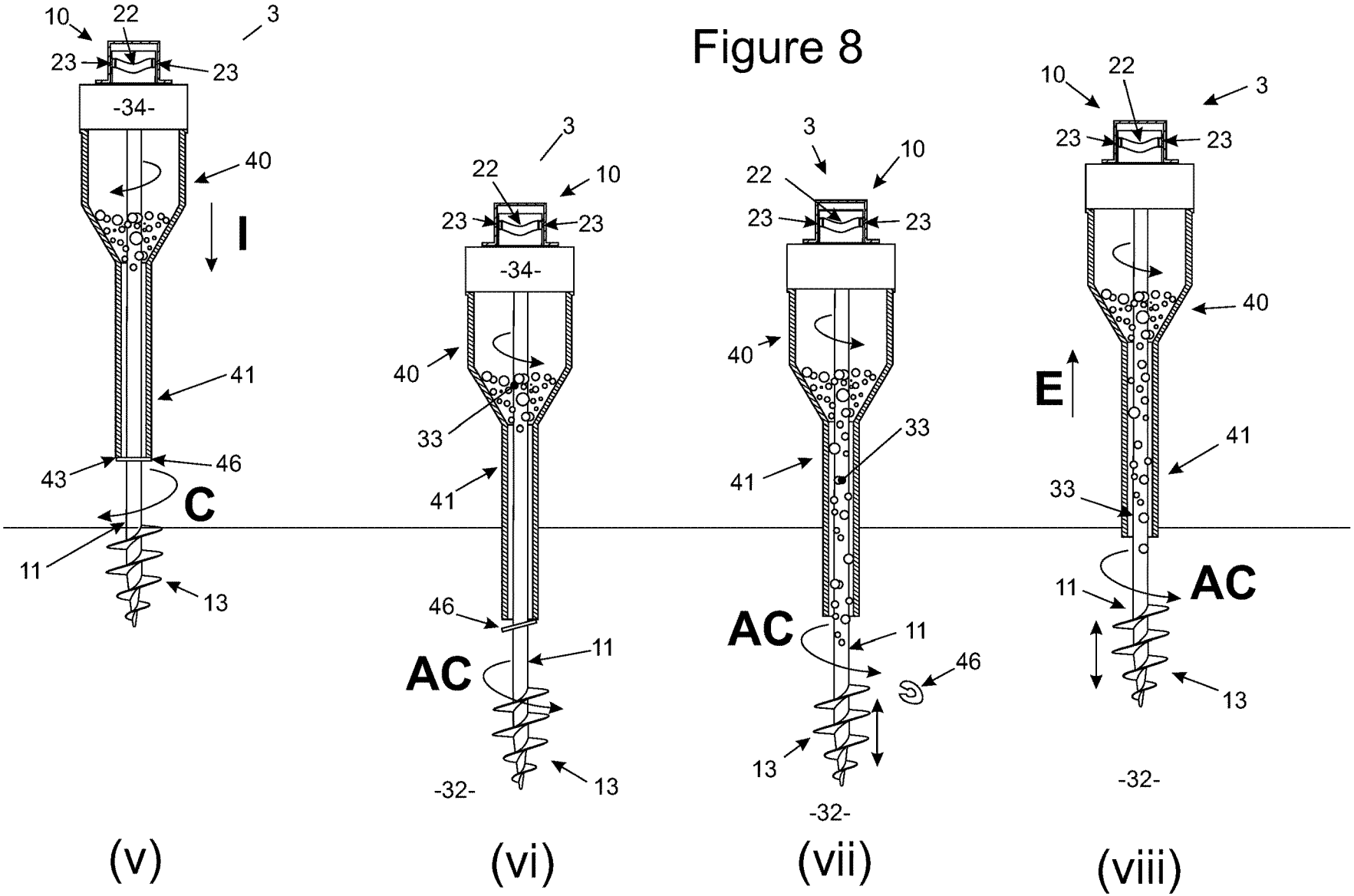
FIG. 8 is a series of four pictorial views that show a method of compacting/modifying the ground using the second embodiment displacement/compaction device.

One preferred method of using the second embodiment is shown in FIG. 8, in the method shown an optional tube cap (46) is shown, this tube cap (46) partially or completely seals the outlet terminal end (43) as the drill assembly (3) is inserted, it is then dislodged at a required depth to allow the additional material (33) in the hopper to flow through the delivery tube (41). The steps of this method include, in order:

Step (v) The drill (11) is rotated in the direction of arrow C as the drill assembly (3) is pushed into the ground in the direction of arrow I.

Step (vi) The drill (11) reaches full depth and it is stopped, then the rotational direction of the drill (11) reversed, shown by arrow AC, at this time the displacement unit (10) is engaged. If present this is most likely the time that the tube cap (46) will be dislodged, released or opened to allow the additional material (33) to pass through the outlet terminal end (43) of the delivery tube (41).

Step (vii) The interaction between the guides (23) in the guide channels (22) causes the drill (11) to vibrate/oscillate as it is rotated in the opposite direction, as shown by arrow AC, and this compacts, and/or modifies the properties of the material (32) around the drill flight (13). This compaction and/or displacement sometimes causes the ground surface to distort or sink, this can require additional material (33) to be added.

Step (viii) The drill (11) is rotated in the reverse direction, in the direction of arrow AC, and withdrawn from the ground (in the direction of arrow E) at a rate which compacts the material and incorporates any additional material (33) supplied from the hopper (40) through the delivery tube (41) to the required level. This operation forming a compacted zone of material (32) that starts at or below the maximum drill (11) depth and extends to the surface, or a point between the lower compacted zone and the surface. The amount of compaction can be varied by adjusting the rotational speed of the drill (11), the torque of the drill (11), the withdrawal rate and the amount/type of additional material (33) added for example.

Figure 9:
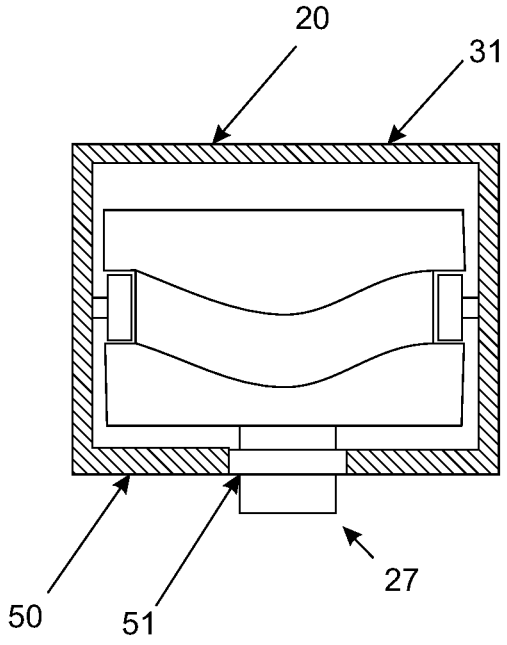
FIG. 9: is a cross sectional view of an alternative form of the displacement unit.

Referring to FIG. 9 an alternative form of the displacement cover (20) is shown in cross section. This form of displacement cover (20) has no outer lip (24) and includes a floor section (50) making it an essentially sealed unit if the connection section (27) passes through a seal (51) in the displacement cover (20). In FIG. 9 the displacement cover (20) is shown as the guide unit (31), this is optional and it could be the channel unit (30) (see FIG. 4*a*).

Figure 10:
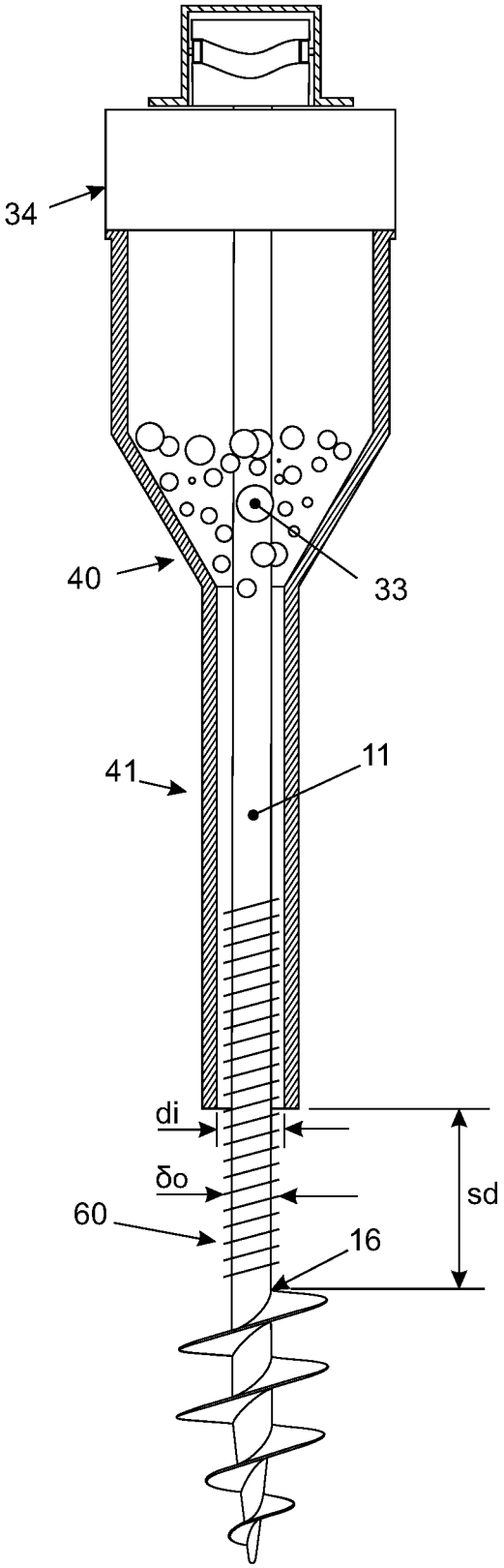
FIG. 10 is a pictorial view of a variant of the second embodiment.

In a variant of the second embodiment, see FIG. 10, there is a shaft flight (60) that extends along the central shaft within the delivery tube (41), the outside diameter (δo) of this flight is less than the inside diameter (di) of the delivery tube (41). This allows the differential longitudinal movement between the drill (11) and the delivery tube (41) created by the displacement unit (11), when in use, to minimise bridging of the additional material (33) as it is fed from the hopper (40).

Figure 11:
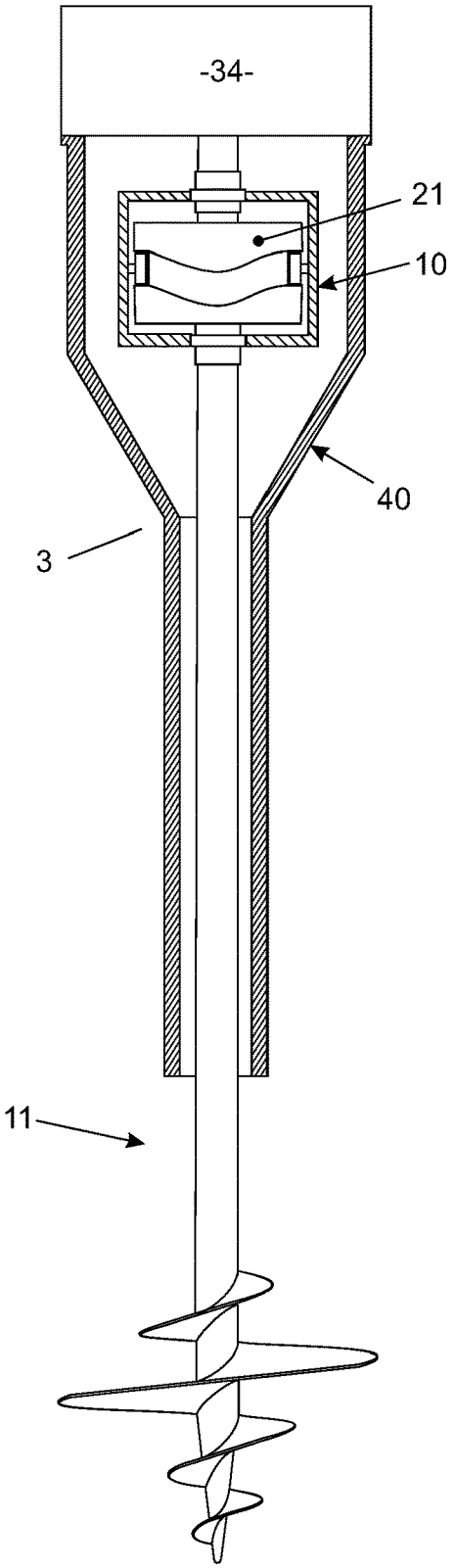
FIG. 11 is a cross sectional view of the second embodiment with the displacement unit located away from the rotary unit.

Please note that in most of the figures the displacement unit (10) is shown close to the rotary head (34) and generally attached to the terminal end of the drill (11), this is not necessarily the case and it can be located along the length of the drill assembly (3) providing the displacement cover (20) can be rotationally locked and isolated from the drill (11), and the core section (21) can be locked to the drill (11) when the displacement unit (10) is required to impart a vibratory/oscillatory motion to the drill (11). One such variant is shown in FIG. 11.

Figure 12:
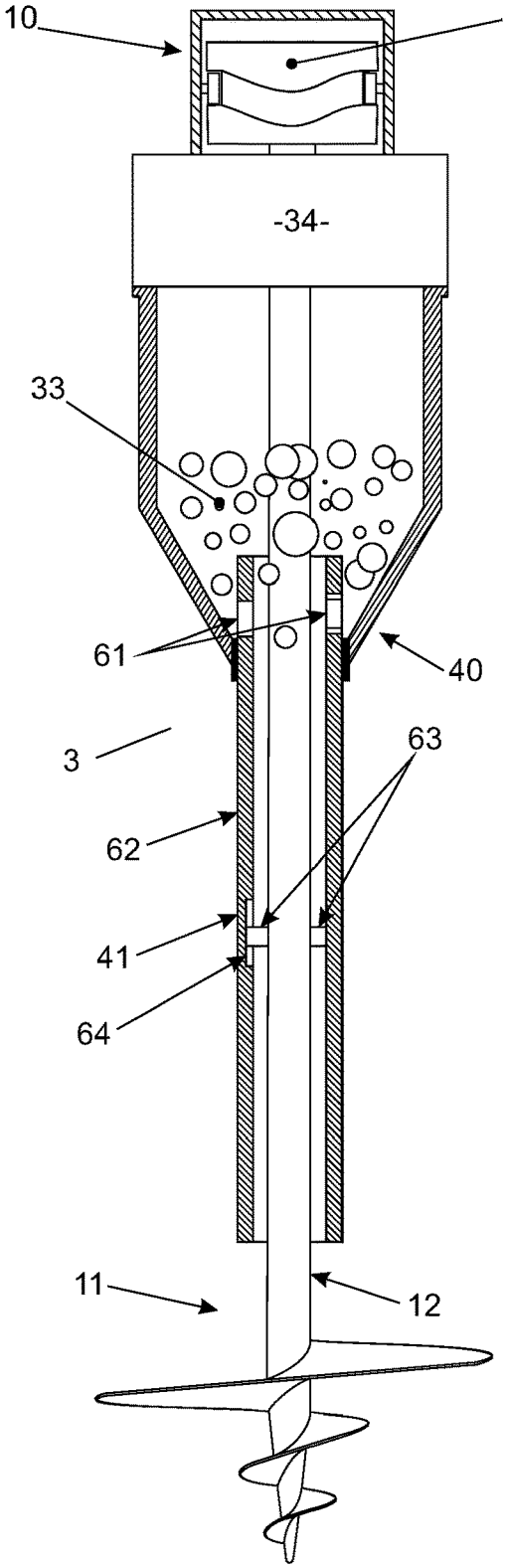
FIG. 12 is a cross sectional view of a variant that has the delivery tube rotationally attached to the central shaft.

FIG. 12 shows a further variant of the drill assembly (3) of the second embodiment. In this case the delivery tube (41) extends inside the hopper (40). The delivery tube (41) is also attached to the central shaft (12) so that as the drill (11) turns so does the hopper (40). This means that the oscillatory/vibratory (longitudinally aligned displacement) motion induced by the displacement unit (10) in operation may be transmitted to the delivery tube (41) and the additional material (33) within the hopper (40). The delivery tube (41) may include optional delivery apertures (61) that are apertures that pass through the side wall (62) of the delivery tube (41). The optional delivery apertures (61) are dimensioned to allow the passage of the additional material (33) from the hopper (40) into the delivery tube (41). The length of the delivery tube (41) extending into the interior of the hopper (40) will depend on the purpose and additional material, and also on whether any delivery apertures (61) are present but it will be sufficient to maintain the inlet terminal end (42) within or coterminous with the hopper (40). The delivery tube (41) may be attached to the central shaft (12) in a variety of ways, the one shown uses shaft-tube attachments (63) which are rods, tubes or flat strips of material extending from the central shaft (12) to the delivery tube (41). In some configurations the shaft-tube attachments (63) may transmit only the rotational motion of the drill (11) to the delivery tube (41) without transmitting the oscillatory/vibratory motion of the drill (11) when the displacement unit (10) is in use. This could be accomplished by engaging the shaft-tube attachments (63) into slots (64) cut into the delivery tube (41).

Figures 13, 13A:
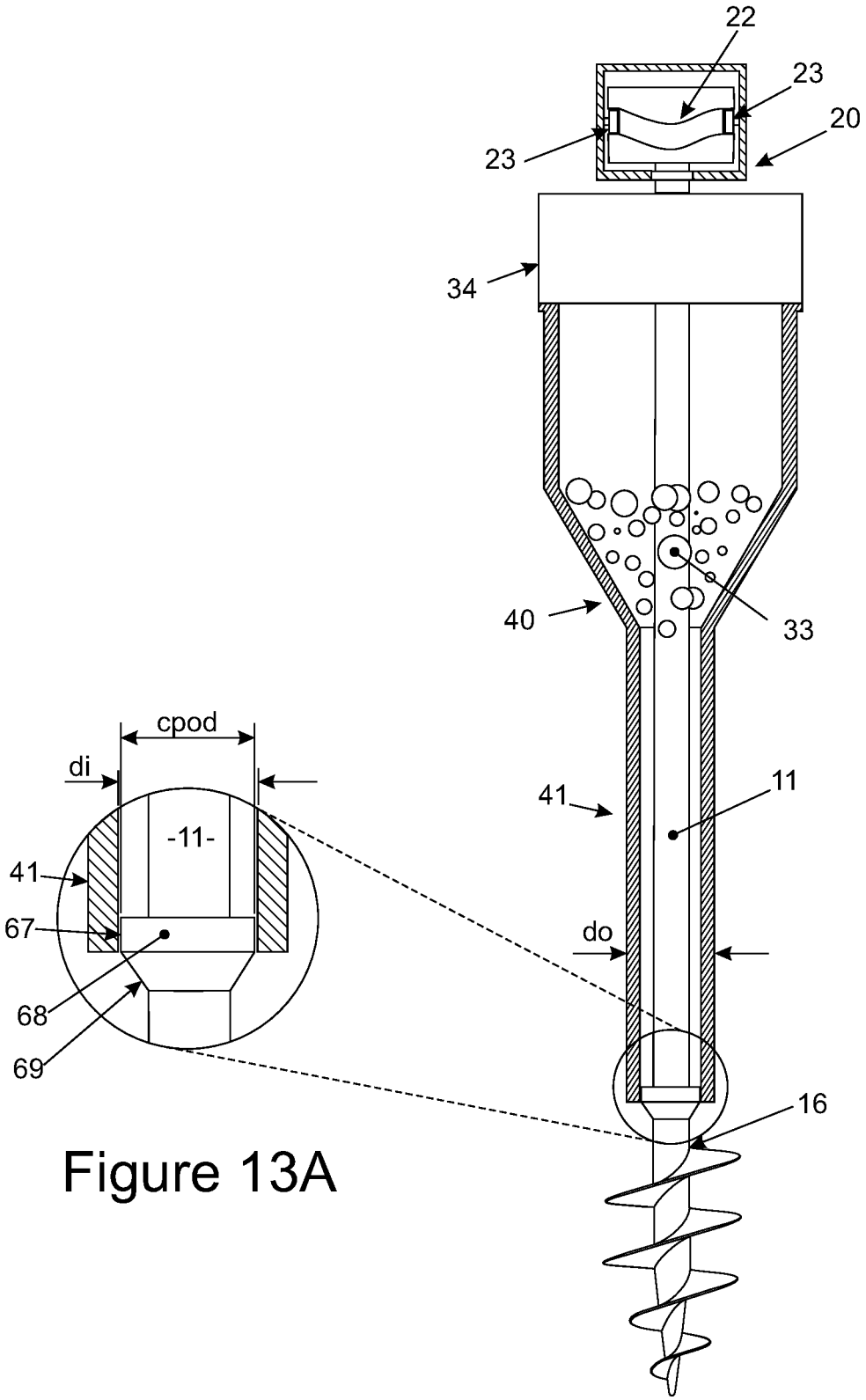
FIG. 13 is a pictorial view of a third embodiment.
FIG. 13A is an enlarged section of the third embodiment shown in FIG. 13.

Referring to FIG. 13 and FIG. 13A a third embodiment of the drill assembly (3) is shown, in this embodiment there is a tube plug (67) attached to, or formed as part of, the central shaft (12) of the drill (11). The tube plug (67) is dimensioned to sit within the delivery tube (41) whilst sealing the end of the delivery tube (41) when required. In FIGS. 13 and 13A the tube plug (67) is shown as including a sealing portion (68) and a tapered portion (69). The sealing portion (68) being a cylindrical portion of the tube plug (67) that has a cylindrical portion outside diameter (cpod) less than di (the inside diameter of the delivery tube (41)) but sufficiently close to di (the inside diameter of the delivery tube (41)) to prevent any detrimental amount of ground material or aggregate from passing along the delivery tube (41) during the insertion of the drill assembly (3) into the ground. A detrimental amount is the amount sufficient to affect the compaction, contaminate the aggregate or otherwise detrimentally affect the operation of the drill assembly (3). The tapered portion (69) is a frusto conical portion of the tube plug (67) that is located closest to the drill flight (13). The minimum diameter of the tapered portion (69) is δ (the outside diameter of the central shaft (12)). To allow differential motion between the drill (11) and the delivery tube (41) it expected that there will be a slight clearance between the tube plug (67) and the delivery tube (41), however, in certain configurations, an additional sealing ring that allows this differential motion may be present, this sealing ring could be an o-ring, a flexible ring, a bushing of known type or a combination of these.

Figure 14:
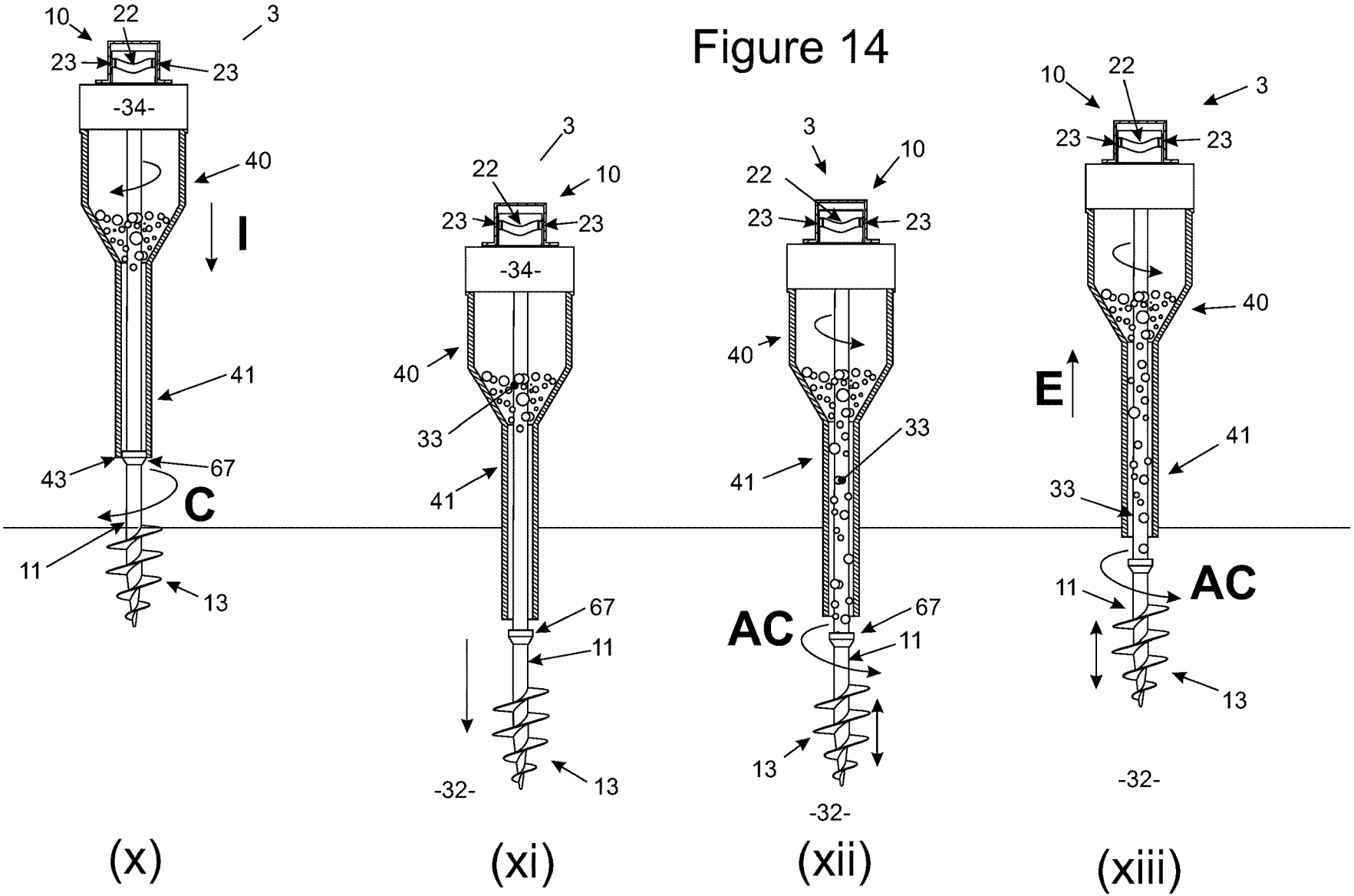
FIG. 14 is a series of four pictorial views that show a method of compacting/modifying the ground using a third embodiment displacement/compaction device.
Figure 15:
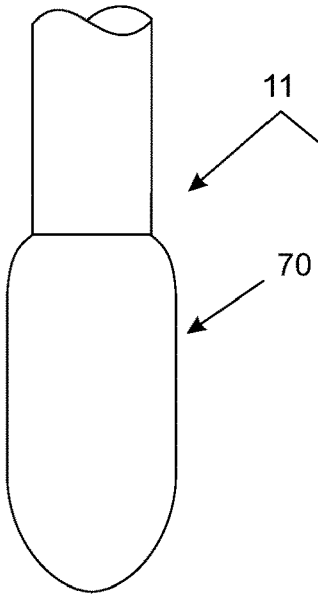
FIGS. 15-19 are a number of alternative drill bit/tip variants.
Figure 16:
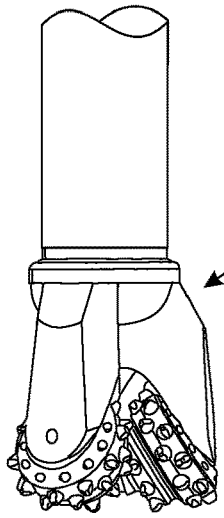
Figure 17:
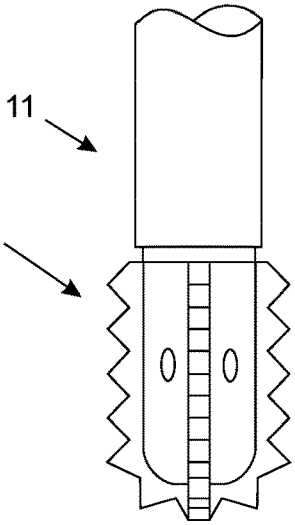

One preferred method of using the third embodiment is shown in FIG. 14. In the method shown the tube plug (67) has the tapered portion (69) extending beyond the outlet terminal end (43) as the drill assembly (3) is inserted, this is optional but it is believed to assist the insertion of the delivery tube (41) into the hole made by the drill (11). The method is similar to that used for the second embodiment of the drill assembly (3), but, rather than dislodging a tube cap (46) (see FIG. 8) at a required depth to allow the additional material (33) in the hopper (40) to flow through the delivery tube (41); the drill (11) is moved in relation to the delivery tube (41) which moves the tube plug (67). The steps of this method include, in order:

Step (x) The drill (11) is rotated in the direction of arrow C as the drill assembly (3) is pushed into the ground in the direction of arrow I. The tube plug (67) is located within the delivery tube (41) acting to seal the outlet terminal end (43).

Step (xi) The drill (11) reaches full depth and the drill (11) is stopped. The drill (11) is moved in relation to the delivery tube (41), this opens the outlet terminal end (43) by moving the tube plug (67) out of the delivery tube (41). The displacement unit (10) is engaged, if it has not been engaged by the movement of the drill (11) in relation to the delivery tube (41). With the outlet terminal end (43) now open the additional material (33) is free to pass through the outlet terminal end (43) of the delivery tube (41).

Step (xii) The drill (11) is now rotated in the direction of arrow AC (the opposite direction to step (x). The interaction between the guides (23) in the guide channels (22) causes the drill (11) to vibrate/oscillate as it is rotated in the opposite direction, and this compacts, and/or modifies the properties of the material (32) around the drill flight (13). The rotation of the drill (11)

also moves material (32) radially outwards. This compaction and/or displacement sometimes causes the ground surface to distort or sink, this can require additional material (33) to be added.

Step (xiii) The drill (11) is rotated in the reverse direction, in the direction of arrow AC, and withdrawn from the ground (in the direction of arrow E) at a rate which compacts the material and incorporates any additional material (33) supplied from the hopper (40) through the delivery tube (41) to the required level. This operation forming a compacted zone of material (32) that starts at or below the maximum drill (11) depth and extends to the surface, or a point between the lower compacted zone and the surface. The amount of compaction can be varied by adjusting the rotational speed of the drill (11), the torque of the drill (11), the withdrawal rate and the amount/type of additional material (33) added for example.

It should be noted that in any of the methods described the additional material (33) may be added to increase the density of the compacted zone even if the surface does not distort or sink.

A tube cap (46) and a tube plug (67) can both be present in a single drill assembly (3) configuration, though this is not shown.

Figure 18:
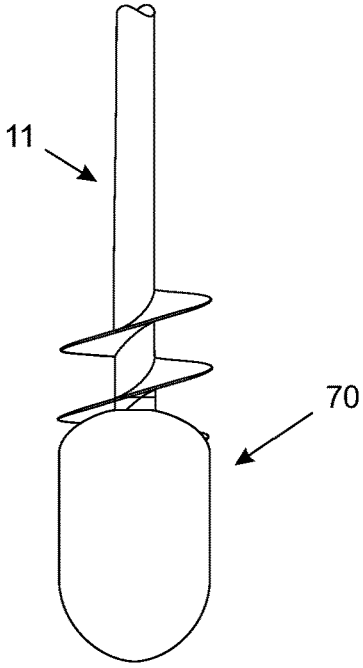

FIGS. 15 to 19 show alternative drill tips/bits (70) that may be used instead of, or in combination with (see FIG. 18), a drill flight (13) (shown in FIG. 18). These are examples only and any drill bit/tip (70) normally used for this sort of work can be used. Noting that the drill flight (13) will normally co-terminate at the terminal end (first end (14)) of the drill (11) that enters the ground first, but if a drill tip/bit (70) is present then it may terminate at or on the drill tip/bit (70).

FIG. 18 shows a combined drill bit/tip with both a drill flight (13) and a bulb end.

Figure 19:
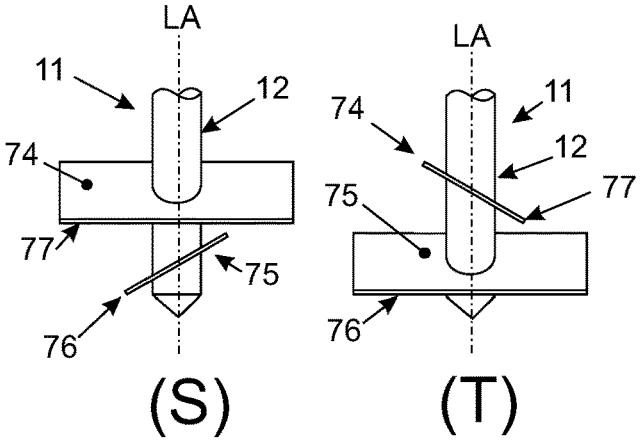

FIG. 19 shows two views of a bladed drill tip/bit where (T) is view (S) rotated 90° about the longitudinal axis (LA), in this variant there are two angled trans-axial flat plates (74,75) attached to the central shaft (12). The flat plates (74,75) are spaced apart along the length of the drill (11), and extend away from both sides of the central shaft (12). In some configurations (not shown) each flat plate (74,75) may be twisted so that the angle of each flat plate (74,75) on each side of the central shaft (12) is such that the lowermost edge (76,77) of each said flat plates (74,75) is a leading edge during insertion of the drill (11). The lowermost edge (76,77) of said flat plates (74,75) is the edge of the flat plate (74,75) in question that enters the ground first when the drill (11) is in use.

Figure 20:
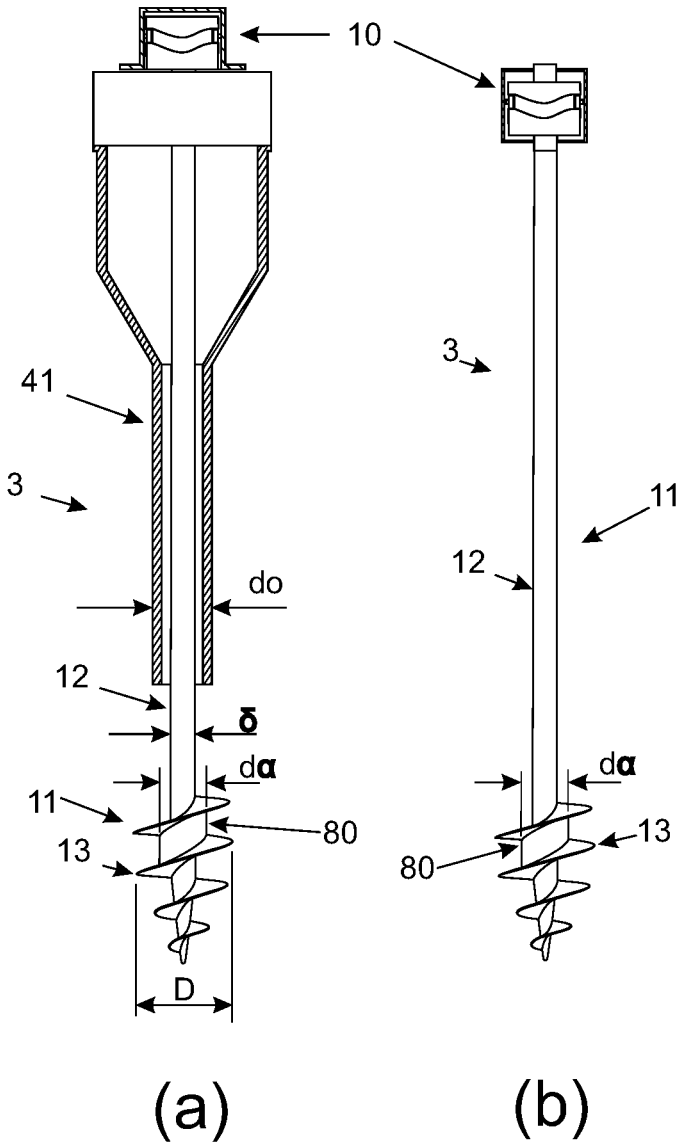
FIG. 20 is a cross sectional view of two variants of the drill (A and B) each with an expanded section of the central shaft within the portion of the drill incorporating the drill flight.

Referring to FIG. 20 (A) and (B) an additional variant of the drill assembly (3) is shown, in this variant the drill (11) includes an alpha section (80). The alpha section (80) in the variant shown is a portion of the drill (11) located within the section of the drill (11) that includes the drill flight (13). In the representations shown the alpha section (80) is a cylinder with a diameter (da) greater than δ (the diameter of the central shaft (12)) but less than D (the maximum diameter of the drill flight (13). In some alternatives the alpha section (80) may be elliptical or oval in cross section, with the longest axis having a length greater than δ (the diameter of the central shaft (12)). When in use a drill assembly (3) that includes a drill (11) with the alpha section (80) creates a larger hole in the ground than one without this expanded section. This larger hole can reduce the power required to insert a drill assembly (3) that includes a delivery tube (41) as the hole can be sized closer to the delivery tube's (41) diameter (do). In some cases the alpha section (80) is not located within the portion of the drill (11) that includes the drill flight (13).

Please note that it is intended that compatible features of the various variants and embodiments can be combined without additional specific description of those variants.

KEY

1 Drilling rig;
2 Excavator/Crane;
3 Drill assembly;
10 Displacement Unit;
11 Drill;
12 Central shaft;
13 Drill flight;
14 First end;
15 Second end;
16 Flight termination point;
20 Displacement cover;
21 Core section;
22 Guide channel;
23 Guide;
24 Outer lip;
25 Core cavity;
26 Core cavity face;
27 Connection section;
30 Channel unit (includes the guide channel);
31 Guide unit (includes the guides);
32 Material;
33 Additional material (one or more of aggregate, grout, concrete, sand, filler material, adhesive material, or similar construction fillers/adhesives);
34 Rotary Head;
40 Hopper;
41 Delivery tube;
42 Inlet terminal end (of delivery tube);
43 Outlet terminal end (of delivery tube);
44 Cylindrical section of hopper;
45 Frusto-conical section of hopper;
46 Tube cap (optional);
50 Floor section;
60 Shaft flight;
61 Delivery apertures (optional);
62 Side wall (of delivery tube);
63 Shaft-tube attachment;
64 Slot (into delivery tube wall for shaft tube attachment);
67 Tube plug;
68 Sealing portion (of the tube plug);
69 Tapered portion (of the tube plug);
70 Drill tip/bit;
74 Flat plate;
75 Flat plate;
76 lowermost edge;
77 lowermost edge;
80 Alpha section;
cpod=outside diameter of the cylindrical portion of the tube plug;
δ=outside diameter of the central shaft;
δo=outside diameter of the shaft flights, if present;
da=outside diameter (maximum) of the alpha section;
di=inside diameter of the delivery tube;
do=outside diameter of the delivery tube;
D=maximum outside diameter of the drill flight;
LA=longitudinal axis of the drill;
sd=separation distance.

The invention claimed is:

1. A drill assembly that includes only one drill and a displacement unit, wherein:

the displacement unit includes a guide unit and a channel unit, where the channel unit includes a guide channel, and said guide unit includes one or more guides adapted to engage with said guide channel, said guide channel being a circumferential channel that follows a wave or wave like path;

the drill includes a drill bit and/or a drill flight attached to a central shaft, wherein the drill bit and/or drill flight co-terminate at a first terminal end of the drill;

said first terminal end is the terminal end of the drill that is configured to enter the ground first; and the central shaft is a thin elongate member that extends between the longitudinally separated terminal ends of the drill; and the drill is releasably or permanently attached to the displacement unit such that when the drill is attached to, and engaged with, the displacement unit, in operation the drill oscillates along its longitudinal axis.

2. The drill assembly as claimed in claim 1 wherein, said drill is an auger.

3. The drill assembly as claimed in claim 1 wherein, said drill bit includes a bulb end.

4. The drill assembly as claimed in claim 1 wherein, said drill assembly includes a delivery tube which circumferentially surrounds a portion of the central shaft.

5. The drill assembly as claimed in claim 4 wherein, the drill flight terminates at a flight termination point which is a separation distance (sd) from an outlet terminal end of the delivery tube.

6. The drill assembly as claimed in claim 4 wherein, a maximum outside diameter of the drill flight and/or drill bit (D) is greater than an outside diameter of the delivery tube (do).

7. The drill assembly as claimed in claim 6 wherein, the maximum outside diameter of the drill flight and/or drill bit (D) is at least 1.1x the outside diameter of the delivery tube (do).

8. The drill assembly as claimed in claim 7 wherein, the maximum outside diameter of the drill flight and/or drill bit (D) is at least 2x the outside diameter of the delivery tube (do).

9. The drill assembly as claimed in claim 8 wherein, the maximum outside diameter of the drill flight and/or drill bit (D) is between 2x and 10x the outside diameter of the delivery tube (do).

10. The drill assembly as claimed in claim 9 wherein, the maximum outside diameter of the drill flight and/or drill bit (D) is between 2x and 6x the outside diameter of the delivery tube (do).

11. The drill assembly as claimed in claim 4 wherein, the delivery tube does not rotate with the drill.

12. The drill assembly as claimed in claim 4 wherein, the drill assembly includes a hopper which is configured to hold additional material, such that said hopper is connected to the delivery tube in such a way as to allow the additional material to flow from the hopper and through the delivery tube when required.

13. The drill assembly as claimed in claim 4 wherein, the delivery tube is connected to the central shaft by at least one shaft-tube attachment so that the delivery tube is configured to rotate with the central shaft.

14. The drill assembly as claimed in claim 13 wherein, the at least one shaft-tube attachment, in use, does not pass on any longitudinal motion of the drill to the delivery tube.

15. The drill assembly as claimed in claim 13 wherein, the at least one shaft-tube attachment is a rigid connection between the delivery tube and the central shaft so that, in use, any rotational and/or longitudinal motion of the central shaft is transmitted to the delivery tube.

16. The drill assembly as claimed in claim 4 wherein, in use, any longitudinal motion of the drill over a pre-set limit is passed on to the delivery tube.

17. The drill assembly as claimed in claim 4 wherein, the delivery tube includes a tube cap, where the tube cap partially or completely blocks an outlet terminal end of said delivery tube, such that said tube cap is configured to release from the delivery tube when required.

18. The drill assembly as claimed in claim 4 wherein, the drill includes a shaft flight that extends along a portion of the length of the central shaft that lies at least partially within the delivery tube.

19. The drill assembly as claimed in claim 4 wherein, the drill includes a tube plug which is attached to or forms part of the central shaft, said tube plug, in a first position, lies within the delivery tube and extends radially from the central shaft towards the delivery tube, such that said tube plug is dimensioned to effectively seal or block the delivery tube in said first position.

20. The drill assembly as claimed in claim 19 wherein, the tube plug is a clearance fit within the delivery tube.

21. The drill assembly as claimed in claim 1 wherein, the drill assembly includes only a single drill in the form of an auger such that, when engaged, the displacement unit imparts a vibration or longitudinal oscillation to the drill that is configured to modify the properties of material surrounding said drill.

22. The drill assembly as claimed in claim 1 wherein, the guide channel follows a smooth wave like path.

23. The drill assembly as claimed in claim 1 wherein, the guide channel is sinusoidal.

24. The drill assembly as claimed in claim 1 wherein, the guide channel is at least 1, and up to 100 (inclusive), wavelengths in length.

25. The drill assembly as claimed in claim 24 wherein, the number of wavelengths is between 1 and 10 inclusive.

26. The drill assembly as claimed in claim 1 wherein, the guide channel is made up of a plurality of partial waves or a superposition of waveforms.

27. The drill assembly as claimed in claim 1 wherein, the guide channel has a peak to trough distance of between 1 mm and 400 mm.

28. The drill assembly as claimed in claim 1 wherein, there is either a drill bit or a drill flight, but not both.

29. The drill assembly as claimed in claim 28 wherein, there is a drill flight.

30. The drill assembly as claimed in claim 29 wherein, the drill includes an alpha section which is a portion of the drill with a maximum cross sectional dimension greater than a maximum cross sectional dimension of the central shaft.

31. The drill assembly as claimed in claim 30 wherein, said alpha section is located within the portion of the drill that includes the drill flight.

32. The drill assembly as claimed in claim 30 wherein, the alpha section, in cross section, is circular, oval or elliptical, with the longest axis being the maximum cross sectional dimension.

33. A method of using a drill assembly claimed in claim 1 including a displacement device and a drill which includes the following steps:

(i) insert drill into a ground surface;

(ii) continue drilling until a required depth is reached then engage the displacement device to commence compacting/consolidating surrounding ground material;

(iii) withdraw drill with displacement device operating.

* * * * *